United States Patent [19]

Kanaya et al.

[11] Patent Number: 5,065,196

[45] Date of Patent: Nov. 12, 1991

[54] ELECTROPHOTOGRAPHIC PRINTER

[75] Inventors: Eizo Kanaya, Shiga; Yoshihiro Chujo, Otsu; Shigehiro Hano, Otsu; Hidetoshi Hara, Otsu, all of Japan

[73] Assignee: Toray Industries, Inc., Tokyo, Japan

[21] Appl. No.: 560,590

[22] Filed: Jul. 31, 1990

[51] Int. Cl.[5] ..... G03G 15/00

[52] U.S. Cl. ..... 355/308; 226/94

[58] Field of Search ..... 355/288, 308, 309; 226/74, 75, 94, 108

[56] References Cited

U.S. PATENT DOCUMENTS

| | | | |
|---|---|---|---|
| 4,086,007 | 4/1978 | Smith et al. | 355/309 |
| 4,110,027 | 8/1978 | Sato et al. | 226/94 X |
| 4,377,333 | 3/1983 | Tsuji et al. | 355/308 X |
| 4,392,738 | 7/1983 | Fujino et al. | 355/308 X |
| 4,429,984 | 2/1984 | Kiba et al. | 355/308 X |
| 4,443,091 | 4/1984 | Aimoya et al. | 355/308 X |
| 4,609,279 | 9/1986 | Hausmann et al. | 355/308 X |
| 4,862,215 | 8/1989 | Nomura et al. | 355/309 |
| 4,890,140 | 12/1989 | Negoro et al. | 355/290 |
| 4,897,691 | 1/1990 | Dyer et al. | 355/288 |
| 4,924,266 | 5/1990 | Negoro et al. | 355/308 X |
| 4,943,863 | 7/1990 | Ainoya | 355/309 X |
| 4,963,941 | 10/1990 | Negishi et al. | 355/308 |

FOREIGN PATENT DOCUMENTS

| | | |
|---|---|---|
| 58-46360 | 3/1983 | Japan . |
| 58-108551 | 6/1983 | Japan . |
| 60-249168 | 12/1985 | Japan . |
| 62-52297 | 11/1987 | Japan . |
| 62-59303 | 12/1987 | Japan . |

*Primary Examiner*—R. L. Moses

*Attorney, Agent, or Firm*—Birch, Stewart, Kolasch & Birch

[57] ABSTRACT

An electrophotographic printer is provided with: a photosensitive drum; a feeding device which feeds a continuous recording sheet; a transfer device which transfers a toner image formed on the photosensitive surface of the drum onto the sheet; a cleaning device which removes residual developer from the photosensitive surface; and a photographic fixing device which fixes the toner image to the sheet. The feeding device includes an endless belt which is located on the downstream side of the drum with reference to the sheet-feeding direction and which travels in one direction. The feeding device also includes a charger which electrically charges the endless belt, so as to allow the sheet to be electrostatically attracted on the endless belt.

9 Claims, 10 Drawing Sheets

ELECTROPHOTOGRAPHIC PRINTER

BACKGROUND OF THE INVENTION

1. Field of the Invention

The present invention relates to an electrophotographic printer using a continuous recording sheet, and more particularly to an electrophotographic printer which is improved in printing accuracy and produces satisfactory print quality.

2. Description of the Related Art

The printing process in which an electrophotographic printer effects printing on a continuous recording sheet will be described. First of all, an electrostatic latent image is formed on a photosensitive drum by utilization of photoconductivity. Then, the electrostatic latent image on the photosensitive drum is developed and visualized with toner, to thereby form an toner image. The toner image, thus formed, is transferred onto a continuous recording sheet supplied to the location of the photosensitive drum. Thereafter, the toner image on the continuous recording sheet is fixed, so as to complete the printing.

As is apparent from the above, the electrophotographic printer is provided with a sheet-feeding device which feeds the continuous recording sheet to the photosensitive drum. The sheet-feeding device includes a tractor unit for feeding the continuous recording sheet to the photosensitive drum, and a pull unit for pulling the continuous recording sheet from the location of the photosensitive drum.

As is disclosed in Japanese Patent Publication No. 62-59303, a pull unit is placed on the downstream side of a photosensitive drum with reference to the direction in which the continuous recording sheet moves. The pull unit includes an endless belt traveling in one direction. This endless belt is extended in the sheet-conveying direction and has a large number of suction holes formed therein. A suction fan is arranged between the top and bottom turns of the endless belt, so as to produce air streams passing through the suction holes of the endless belt. Thus, the suction fan is worked under the movement of the endless belt, and the continuous recording sheet, which has passed by the photosensitive drum, is sucked onto the moving endless belt and is conveyed in accordance with the movement of the endless belt.

However, the suction-type pull unit mentioned above has problems, in that the sheet-pulling force varies depending upon the width of a continuous recording sheet to be used. If the continuous recording sheet is narrower than the endless belt, some of the suction holes of the endless belt are outside of the range of the continuous recording sheet and are therefore exposed. If the suction holes are partly exposed, air is sucked mainly through the exposed suction holes, with the result that the suction force is reduces. Therefore, the continuous recording sheet cannot be reliably pulled, and it cannot be conveyed in a stable manner.

As the continuous recording sheet, a fanfold sheet is often used which can be folded or separated along folding lines provided in the longitudinal direction at regular intervals. Assume that this fanfold sheet is used in the above-mentioned printer and is not sufficiently pulled during conveyance. In this case, it is likely that the fanfold sheet will not be stretched tight during conveyance, particularly at the portions located in the neighborhood of the folding lines. Since, therefore, the portions in the neighborhood of the folding lines may not be brought into reliable contact with the photosensitive drum, defective image transfer is likely to occur, resulting in so-called image omission. If the fanfold sheet is thick, the defective image transfer occurs very often, since the thick fanfold sheet tends to be folded or bent at the folding lines.

The pull unit mentioned above is a type which is made up of a suction fan and suction holes. In addition to this type, another type of pull unit is known in the art, which comprises a feed roll driven with constant torque, and a nip roll which is in rolling contact with the feed roll. A fanfold sheet is fed such that it passes through the region between the two rolls. However, this type of pull unit has a similar problem to that mentioned above. When the folding line portions of the fanfold sheet pass the region between the rolls, the nip roll is raised or moved away from the feed roll. As a result, the force with which to pull the fanfold sheet is temporarily varied. Consequently, the toner image on the photosensitive drum may not be transferred onto the intended position on the fanfold sheet.

In the electrophotographic printer, the device for feeding a continuous recording sheet requires improvement, so as to solve the above-noted problem and therefore to enhance the printing accuracy. Further, a cleaning device, which removes the toner (i.e., a developer) remaining on the photosensitive drum after the image transfer, a photographic fixing device, which fixes the toner image transferred onto the continuous recording sheet, and some other structural components also require improvement, so as to enhance the print quality.

SUMMARY OF THE INVENTION

Accordingly, the main object of the present invention is to provide an electrophotographic printer wherein the device for feeding a continuous recording sheet is improved, so as to enhance the accuracy of printing. Another object of the present invention is to provide an electrophotographic printer wherein the cleaning device and the photographic fixing device are improved, so as to enhance the print quality.

To achieve the above objects, the present invention provides an electrophotographic printer which comprises: a photosensitive medium having a movable photosensitive surface; means for uniformly charging the photosensitive surface of the photosensitive medium; means for forming an electrostatic latent image on the charged photosensitive surface; developing means for affixing toner to the electrostatic latent image on the photosensitive surface by use of a developer, so as to obtain a toner image; a feeding device for feeding a continuous recording sheet to the photosensitive medium; means for transferring the toner image from the photosensitive medium onto the continuous recording sheet; a cleaning device for clearing the photosensitive surface of the photosensitive medium, so as to remove the developer which remains on the photosensitive surface after the toner image is transferred onto the continuous recording sheet; a photographic fixing device for fixing the toner image transferred onto the continuous recording sheet; and means for removing the electric charge from the photosensitive surface of the photosensitive medium after the photosensitive surface is cleaned by the cleaning device.

The feeding device of the printer of the present invention includes tractor means and pull means. The tractor means is located on the upstream side of the photosensitive medium with reference to the feeding direction of the continuous recording sheet, and feeds the continuous recording sheet to the photosensitive medium. The pull means is located on the downstream side of the photosensitive medium with reference to the feeding direction of the continuous recording sheet, and pulls the continuous recording sheet from the location of the photosensitive medium. The pull means is made up of: a pair of rolls isolated from each other in the feeding direction; an endless belt extended between the paired rolls and which can be electrically charged; driving means for rotating one of the rolls, to thereby cause the endless belt to travel in one direction; and charging means, arranged in the neighborhood of the endless belt, for electrically charging the endless belt.

In the sheet-feeding device, the endless belt is electrically charged by the charging means. After passing by the photosensitive medium, the continuous recording sheet is electrostatically attracted by the endless belt and is conveyed in accordance with the movement of the endless belt. Due to the utilization of the electrostatic attraction, the suction force acting on per unit area of the continuous recording sheet is always constant independent of the widths of continuous recording sheets. Accordingly, the force with which to pull the continuous recording sheet is stabilized. Since even a fanfold sheet is sufficiently pulled during conveyance, it can be guided to the photosensitive medium, with the folding line portions being reliably stretched. Accordingly, defective transfer of an image is prevented, and the image is reliably transferred onto an intended portion of the continuous recording sheet.

The cleaning device incorporated in the printer of the present invention does not merely remove the residual toner from the photosensitive surface of the photosensitive medium. The cleaning device includes means for removing the toner fluidizer contained in the developer from the photosensitive surface, without leaving any scratch on the photosensitive surface.

The photographic fixing device also incorporated in the printer of the present invention includes means for stably fixing the toner image by using both radiant heat energy and optical energy of flashlight, without decomposing the toner.

Due to the use of the above two means respectively incorporated in the cleaning device and the photographic device, the quality of an electrophotographic image formed on the continuous recording sheet is improved.

The above-mentioned features (namely, the improvements on the sheet-feeding device, the cleaning device, and the photographic fixing device) and the relevant advantages will become more apparent from the following detailed description taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
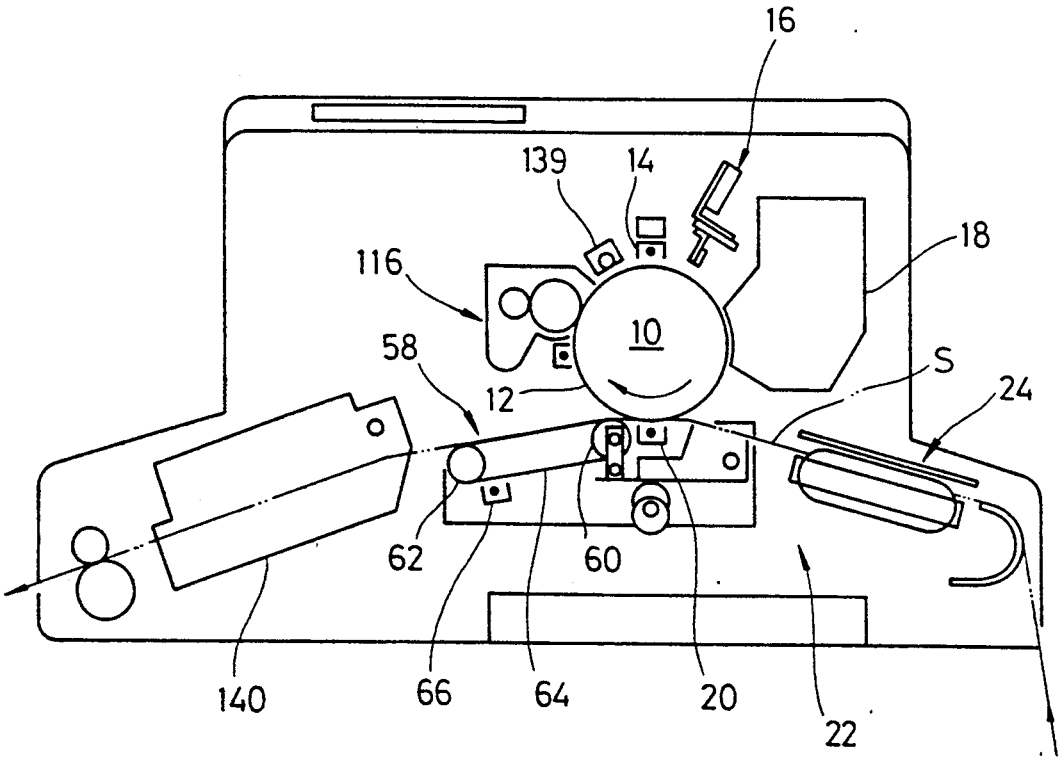
FIG. 1 is a schematic view of an electrophotographic printer according to one embodiment of the present invention.

FIG. 1 is a schematic view of the entire electrophotographic printer of the present invention. The printer comprises a photosensitive drum 10 (i.e., a photosensitive medium). The circumference of the photosensitive drum 10 is a photosensitive surface 12. The photosensitive drum 10 can be rotated by a drive source (not shown) at a constant speed in the direction indicated by an arrow in FIG. 1.

A first charger 14 is arranged right above the photosensitive drum 10 such that it is located close to the photosensitive surface 12. The portion of the photosensitive surface 12 which passes the region just under the charger 14 is uniformly electrically charged by the first charger 14.

In the neighborhood of the first charger 14, an exposure device 16 and a developing device 18 are arranged in the rotating direction of the photosensitive drum 10 in the order mentioned. The exposure device 16 incorporates an array of light-emitting diodes, from which light beams are emitted toward the photosensitive drum 10 in accordance with printing data. When the photosensitive surface 12 of the photosensitive drum 10 is irradiated with the light beams, an electrostatic latent image is formed corresponding to the printing data. To the electrostatic latent image toner is affixed by the developing device 18 and is therefore visualized as a toner image. It should be noted that the developer used by the developing device 18 is a dry type of one-component system, as is disclosed in U.S. Pat. No. 4,395,485, and contains electrically-insulating toner particles, and electrically-insulating fluidizer which accelerates the fluidity of the toner particles.

The toner particles used in the embodiment have an average diameter of 8 μm. The fluidizer used in the embodiment is made of a material which is frictionally charged into an opposite polarity to that of the toner particles. For example, the fluidizer is formed by hydrophobic silica particles which have an average diameter of 0.02 μm. The content of the fluidizer in the developer is 2% by weight. Not only the hydrophobic silica but also another inorganic material, such as ordinary silica or alumina, may be used as the fluidizer. Moreover, the developer may be a dry type of two-composition system, which includes carrier particles made of iron oxide or ferrite, in addition to the toner particles and the fluidizer, as is disclosed in U.S. Pat. No. 4,482,621.

A transfer device 20 is arranged just under the photosensitive drum 10. In other words, it is arranged in opposition to the first charger 14, with the photosensitive drum 10 interposed. The transfer device 20 includes a charger having a similar structure to that of the first charger 14, and transfers the toner image from the photosensitive surface 12 of the photosensitive drum 10 to a continuous recording sheet S.

The continuous recording sheet S is a fanfold sheet wherein folding lines are provided at predetermined intervals in the longitudinal direction. The fanfold sheet can be folded or separated along the folding lines. As is shown in FIG. 2, sprocket holes h are formed on each side of the fanfold sheet and are spaced from each other at regular intervals.

To feed the continuous recording sheet S to the photosensitive drum 10, a feeding device 22 is employed. This feeding device 22 will be described in detail, with reference to FIGS. 2 through 7. The feeding device 22 includes a pair of tractor units 24 which are located on the upstream side of the photosensitive drum 10 with reference to the direction in which the continuous recording sheet S is fed. As is apparent from FIG. 2, the tractor units 24 engage with the respective sides of the continuous recording sheet S, and are slidably mounted on both a driving shaft 26 and a guide rod 28. The driving shaft 26 and the guide rod 28 are parallel to each other and extend across the continuous recording sheet S. The end portions of the driving shaft 26 and those of the guide rod 28 are supported by a feeding frame 30 extending along the continuous recording sheet S. The end portions of the driving shaft 26 are rotatably supported with the feeding frame 30. As is apparent from FIG. 4, the driving shaft 26 is formed with a spline shaft.

Each tractor unit 24 includes: a driving wheel 32 which engages with the spline shaft 26 (i.e., the driving shaft); a driven wheel 34 which is isolated from the driving wheel 32 in the longitudinal direction of the continuous recording sheet S; and an endless sprocket chain 36 extended between the driving wheel 32 and the driven wheel 34. The sprocket chain 36 has a large number of sprockets 38 engageable with the sprocket holes h of the continuous recording sheet S. Each tractor unit 24 further includes upper and lower paper guides 40*a* and 40*b*. Each of these paper guides 40*a* and 40*b* has a groove 42 and a slit which allow the sprockets 38 to pass therethrough. Incidentally, reference numeral 46 in FIG. 4 denotes a knob which is used for fixing the position of the tractor unit 24. In other words, the knob 46 is used for preventing the tractor unit 24 from slipping axially with reference to the driving shaft 26 and the guide rod 28.

Figure 2:
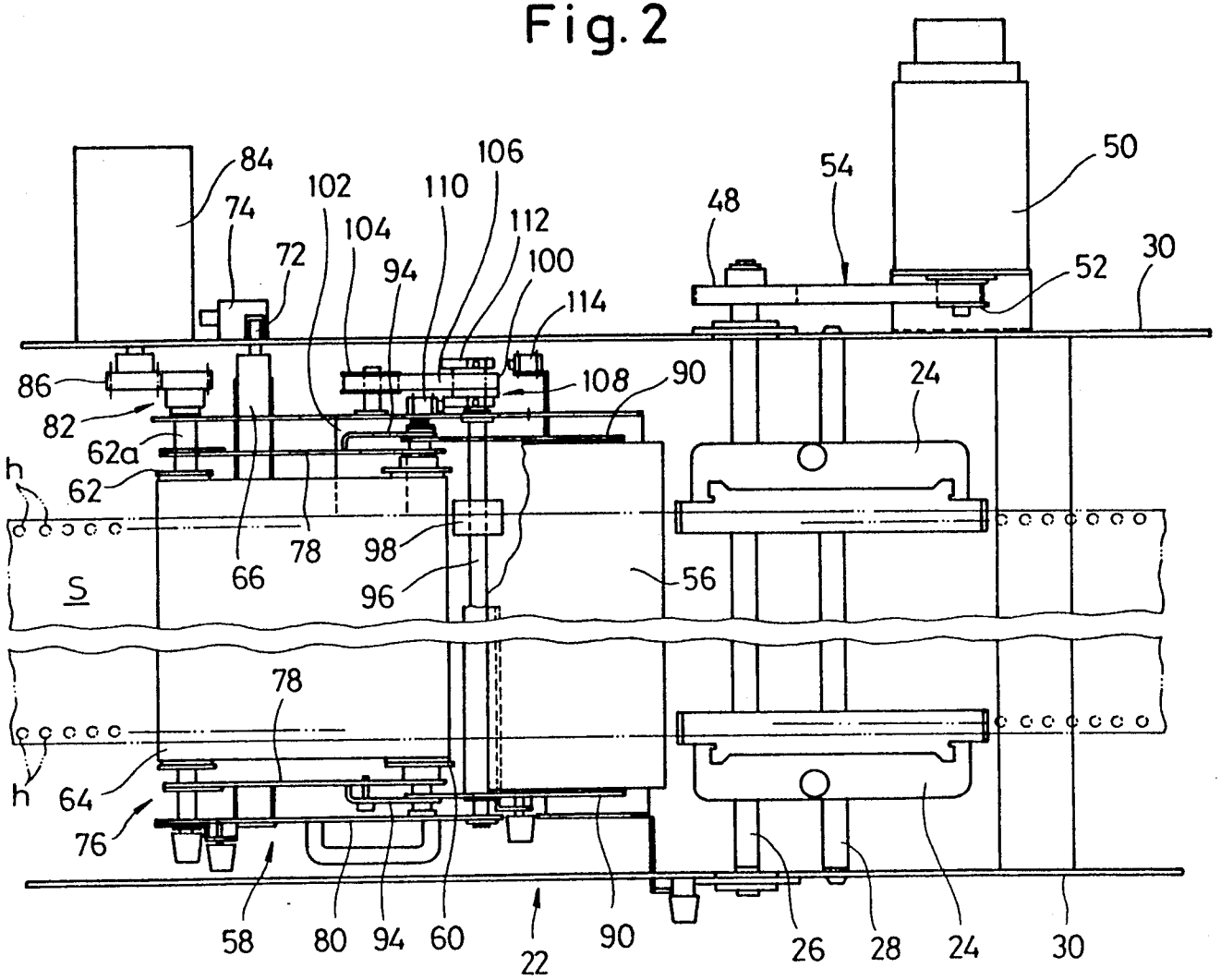
FIG. 2 is a plan view of a continuous recording sheet-feeding device incorporated in the printer shown in FIG. 1.

As is shown in FIG. 2, a pulley 48 is attached to one end of the driving shaft 26. A driving motor 50 for driving the tractor units 24 is located in the neighborhood of the pulley 48. A pulley 52, which is paired with the pulley 48, is attached to the output shaft of the driving motor 50. A driving belt 54 is extended between the two pulleys 48 and 52. When the driving motor 50 is actuated, the sprocket chain 36 of each tractor unit 24 travels in one direction. Since the sprockets of the sprocket chains 36 engage with the sprocket holes h of the continuous recording sheet S, the continuous recording sheet S is fed toward the photosensitive drum 10. It should be noted that the speed at which the continuous recording sheet S is fed by the paired tractor units 24 corresponds substantially to the circumferential speed of the photosensitive drum 10.

Figure 3:
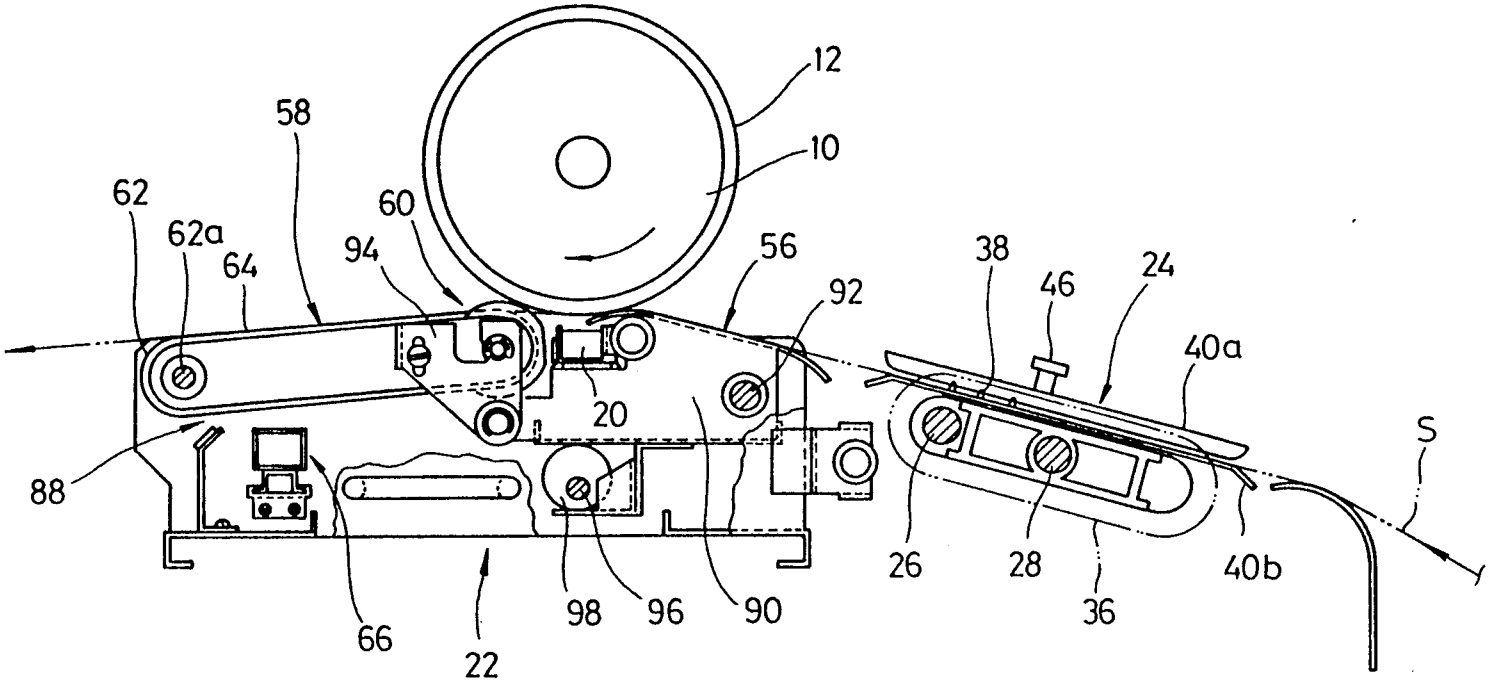
FIG. 3 is a side view of the sheet-feeding device shown in FIG. 2.
Figure 4:
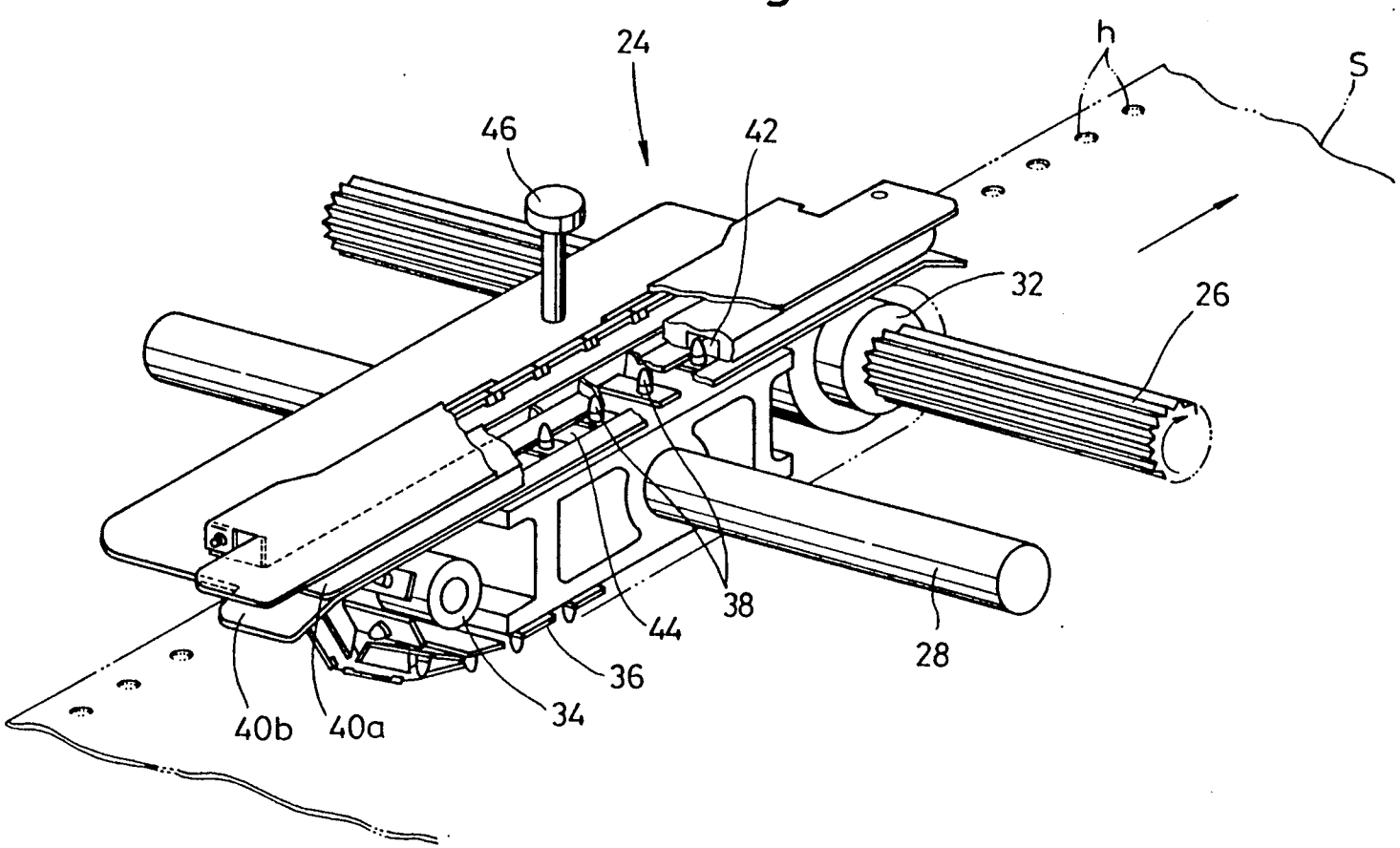
FIG. 4 is a perspective view of a tractor unit included in the sheet-feeding device shown in FIG. 2.
Figure 5:
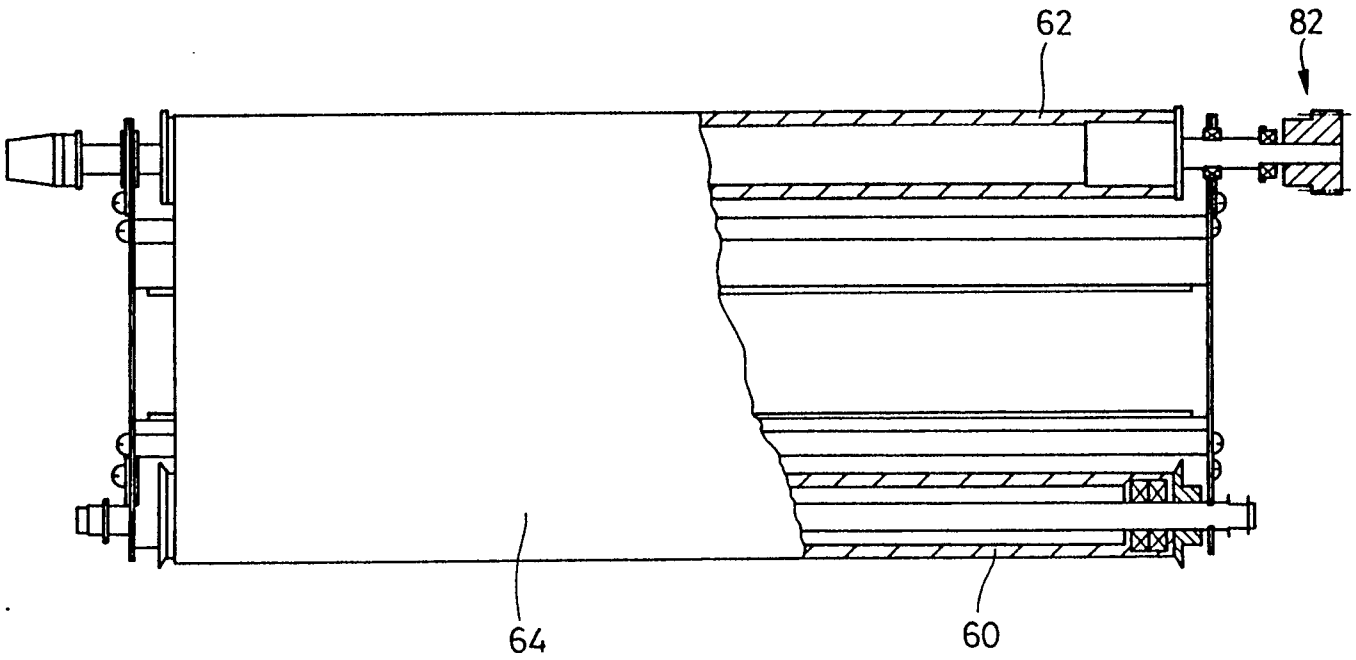
FIG. 5 is a partially-cutaway plan view of a pull unit included in the sheet-feeding device shown in FIG. 2.
Figure 6:
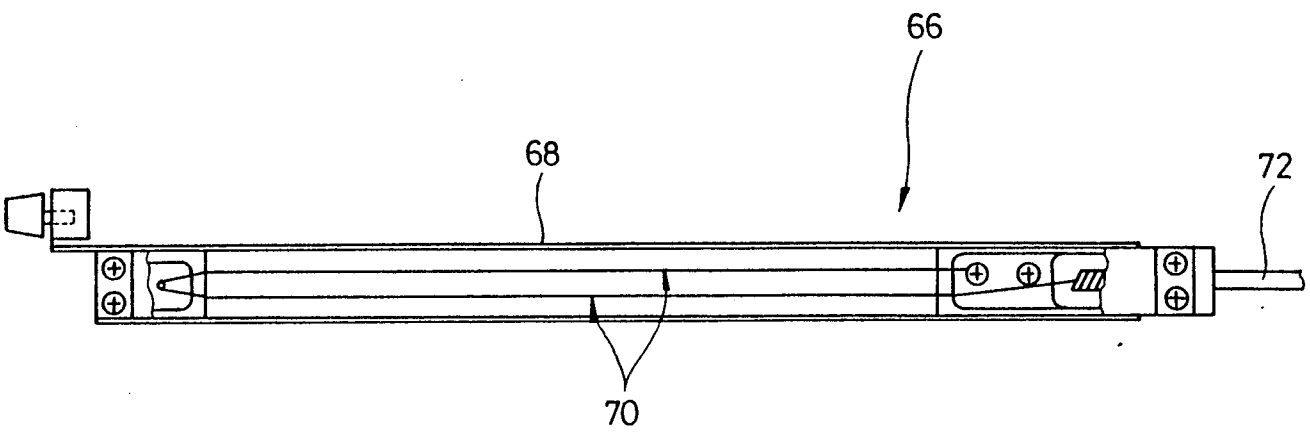
FIG. 6 is a plan view of an electric charger incorporated in the printer shown in FIG. 1.

As is shown in FIG. 3, a guide plate 56 is located between the photosensitive drum 10 and the paired tractor units 24. The guide plate 56 serves to reliably guide the continuous recording sheet S toward the photosensitive surface 12 of the photosensitive drum 10.

A pull unit 58 is located on the downstream side of the photosensitive drum 10 with reference to the feeding direction of the continuous recording sheet S. The pull unit 58 includes: a driven roll 60 located in the neighborhood of the photosensitive drum 10; a driving roll 62 isolated from the photosensitive drum 10 in the feeding direction of the continuous recording sheet S; and an endless belt 64 extended between the driving roll 62 and the driven roll 60. The structures of the driving and driven rolls 62 and 60 are shown in detail in FIG. 5.

As is apparent from FIG. 2, the endless belt 64 is wider than the continuous recording sheet S. It is formed of a material which can be electrostatically charged, such as polyester or polyethylene tetrafluoride.

As is shown in FIGS. 2 and 3, a charger 66 is arranged under the endless belt 64. The charger 66 is elongated in the widthwise direction of the endless belt 64, and the structure thereof is shown in detail in FIG. 6. The charger 66 is similar in structure to the first charger 14 and transfer device 20 mentioned above, and is made up of a shield case 68 and a charging wire 70 contained inside the shield case 68. As is shown in FIG. 2, the charging wire 70 is connected to a high-voltage connector 74 through a terminal 72, and the high-voltage connector 74 is connected to a high-voltage d.c. power source (not shown).

In the pull unit 58, the ends of the driving roll 62 and those of the driven roll 60 are rotatably supported by a unit frame 76 (FIG. 2), and the unit frame 76 is swingably supported by a support frame 80. More specifically, the roll shaft 62*a* of the driving roll rotatably extends through both the unit frame 76 and the support frame 80, and is supported by the support frame 80. Therefore, the unit frame 76 (consequently, the endless belt 64) is swingable about the roll shaft 62*a*. A gear 82 is attached to one end of the roll shaft 62*a*. This gear 82 is in mesh with a gear 86 attached to the output shaft of a driving motor 84.

When the driving motor 84 is actuated, the driving roll 62 is rotated in one direction by the gears 86 and 82. Thus, the endless belt 64 is driven such that the continuous recording sheet S is pulled from the location of the photosensitive drum 10. Simultaneous with the actuation of the driving motor 84, the charging wire 70 of the charger 66 is applied with a high voltage. Since, therefore, the endless belt 64 is charged, it electrostatically attracts the continuous recording sheet S which is discharged from the photosensitive drum 10 and onto which a toner image is transferred. In accordance with the movement of the endless belt 64, the continuous recording sheet S is pulled from the location of the photosensitive drum 10. It should be noted that the speed at which the continuous recording sheet S is fed by the endless belt 64 is slightly higher than the speed at which the continuous recording sheet S is fed by the paired tractor units 24.

In the manner mentioned above, the endless belt 64 conveys the continuous recording sheet S while electrostatically attracting it. Thus, that portion of the sheet S which is between the paired tractor units 24 and the pull unit 58 can be stretched uniformly. The electric potential of the continuous recording sheet S, relative to the endless belt 64 and caused by the electrostatic induction, is increased with thickness of the sheet S. Therefore, a thicker sheet S can be pulled by the endless belt with a larger tensile force. As a result, even if the continuous recording sheet S is a thick fanfold sheet, the folding line portions can be sufficiently stretched, so that the omission of a toner image is prevented from occurring when the folding line portions pass through the region between the photosensitive drum 10 and the transfer device 20. Moreover, since the force with which the continuous recording sheet S is pulled by the endless belt is stable, the toner image can be transferred accurately to the intended position.

As is shown in FIG. 3, a discharging brush 88 is arranged in the neighborhood of the endless belt 64, so as to prevent the endless belt 64 from being overcharged. Due to the use of this discharging brush 88, the endless belt 64 does not electrostatically attract the continuous recording sheet S too strongly. Even if the continuous recording sheet S is overfed, it slips on the endless belt 64, so that the overfeeding of the continuous recording sheet S can be corrected.

Figure 7:
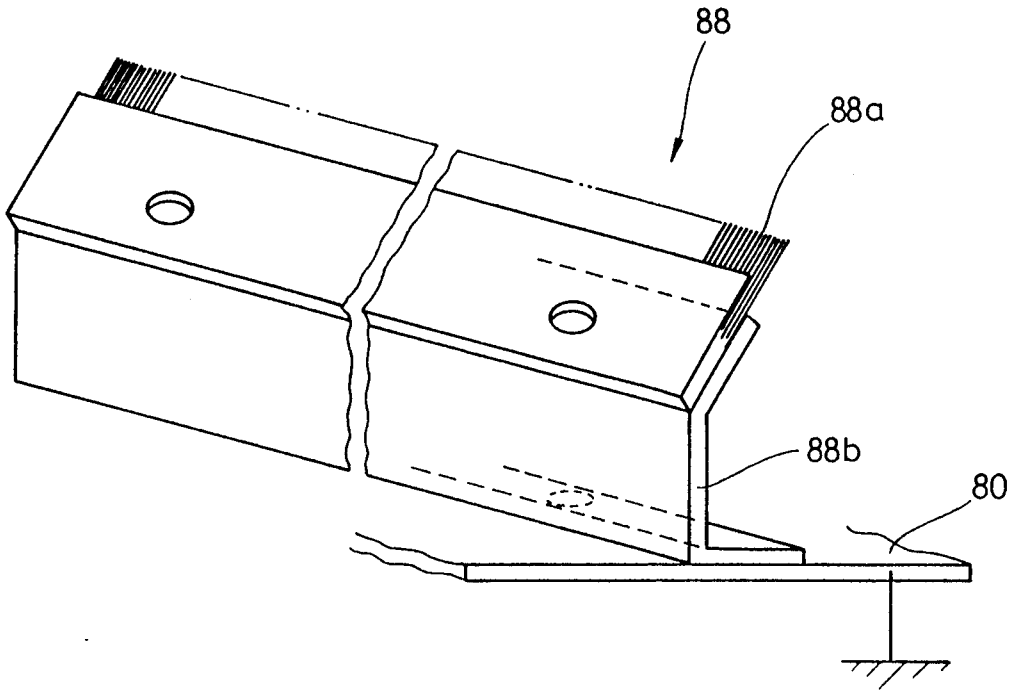
FIG. 7 is a perspective view of a discharging brush incorporated in the printer shown in FIG. 1.

FIG. 7 shows a detailed arrangement of the discharging brush 88. As shown in the figure, the discharging brush 88 comprises a brush portion 88*a* including highly electroconductive filaments such as metal filaments or carbon filaments, and a brush support portion 88*b*. The brush portion 88*a* is grounded via the brush support portion 88*b* and a supporting frame 80.

The distal end of the discharging brush, namely, the brush portion 88*a*, is located close to or lightly touches the surface of the endless belt 64 which is electrostatically charged, whereby the surface of the endless belt 64 is discharged by a self-discharging due to the potential difference between the surface of the endless belt 64 and the brush portion 88*a* and by a direct leakage of the electric charge due to the contact of the brush portion 88*a* with the belt, thereby preventing an overcharging of the belt.

As mentioned above, the pull unit 58 is swingable around the roll shaft 62*a* of the driving roll 62. Like this structure, the transfer device 20 and the guide plate 56 are attached to a transfer frame 90, and this transfer frame 90 is swingably supported by the support frame 80 through a support shaft 92 (FIG. 3). The transfer frame 90 and the unit frame 76 are coupled to each other through a pair of link plates 94.

As is shown in FIG. 3, a cam shaft 96 is arranged under the transfer frame 90. The cam shaft 96 extends in the widthwise direction of the continuous recording sheet S, and its two ends are rotatably supported by the support frame 80. A cam 98 is attached to the cam shaft 96. The cam 98 is in contact with the bottom face of the transfer frame 96, so that it supports both the transfer frame 90 and the pull unit 58.

As is shown in FIG. 2, one end of the cam shaft 96 is projected outward from the support frame 80, and a pulley 100 is attached to the projected end of the cam shaft 96. A driving motor 102 is attached to the support frame 80. A pulley 104, which is paired with the pulley 100, is attached to the output shaft of the driving motor 102. A driving belt 106 is extended between the two pulleys 100 and 104, so that the torque of the driving motor 102 can be transmitted to the cam shaft 96.

In the state illustrated in FIG. 3, the transfer frame 90 and the pull unit 58 are located at the upper position relative to the photosensitive drum 10. In other words, they are at the printing position where printing is effected with respect to the continuous recording sheet S. When the transfer frame 90 and the pull unit 58 are at the printing position, a first dog 108 attached to the projected end of the cam shaft 96 keeps a first limit switch 110 in an ON state. Thus, the driving motor 102 is at rest. When the driving motor 102 is actuated, the cam shaft 96 is rotated, with the result that the transfer frame 90 is swung downward around the support shaft 92. Simultaneously, the pull unit 58, which is coupled to the transfer frame 90 through the link plates 94, is swung downward around the roll shaft 62*a* of the driving roll 62. As a result, the endless belt 64, the transfer device 20 and the guide plate 56 move downward in a direction away from the photosensitive drum 10.

When the pull unit 58 and the transfer frame 90 reach the predetermined position, a second dog 112 attached to the projected end of the cam shaft 96 turns on a second limit switch 114, as is understood from FIG. 2. Accordingly, the driving of the motor 102 is stopped.

As mentioned above, the pull unit 58 and the transfer frame 90 are movable between the upper position and the lower position. Therefore, the continuous recording sheet can be easily loaded in the printer, with the pull unit 58 and the transfer frame 90 being located at the lower position. This structure enables automatic loading of the continuous recording sheet S.

Figure 8:
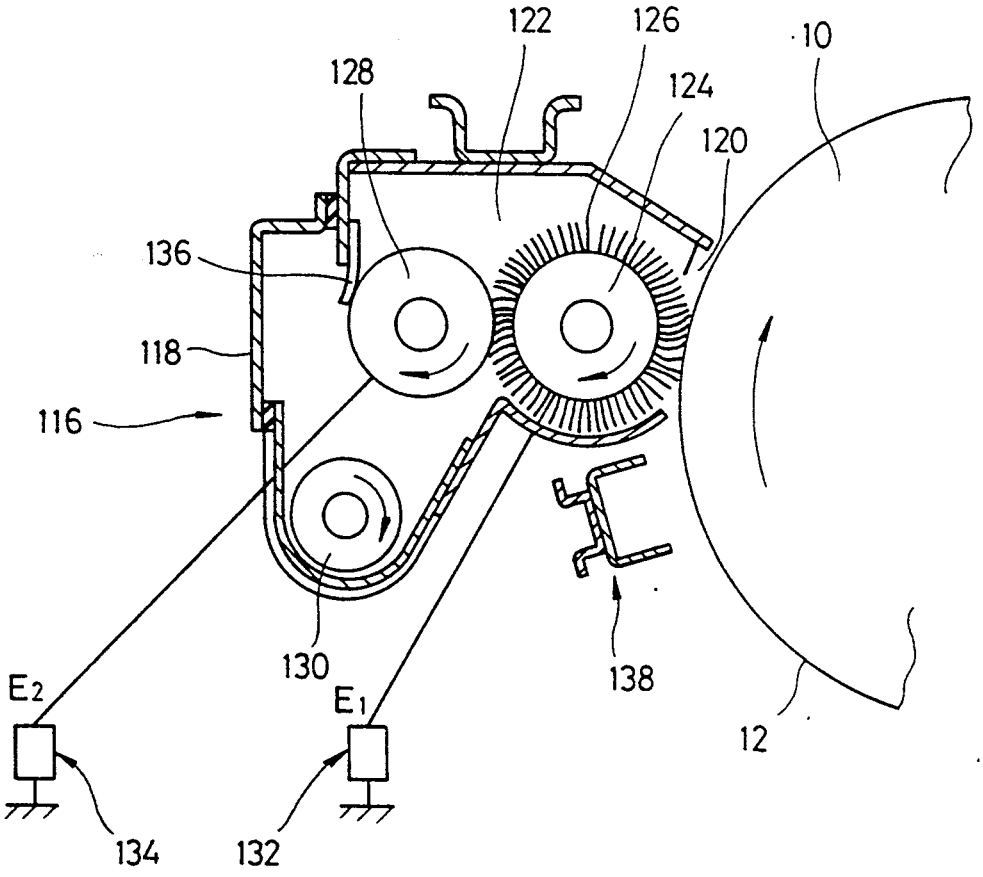
FIG. 8 is a sectional view of a cleaning device incorporated in the printer shown in FIG. 1.

FIG. 8 shows a device 116 for cleaning the photosensitive drum 10. With reference to the rotating direction of the photosensitive drum 10, the cleaning device 116 is located on the downstream side of the transfer device 20 and on the upstream side of the first charger 14, as is apparent from FIG. 1.

Referring to FIG. 8, the cleaning device 116 comprises a housing 118. This housing 118 is arranged close to the photosensitive surface 12 of the photosensitive drum 10, and has an opening 120 in the region facing the photosensitive surface 12. Inside the housing 118, a brush roll 122 is rotatably supported. This brush roll 122 is made up of a roll body 124 formed of an electrically-conductive material, such as aluminum alloy, and soft filaments 126 provided on the entire circumference of the roll body 124. The soft filaments 126 are formed by chemical fibers and contains a conductive material, such carbon powder. The soft filaments 126 are adhered to the circumference of the roll body 124 and has a resistance in the range of, e.g., $10^8$ to $10^{10}$ Ω/cm.

When the soft filaments 126 of the brush roll 122 come to the location of the opening 120 of the housing 118, they are brought into contact with the photosensitive surface 12 of the photosensitive drum 10.

Inside the housing 118, a recovery roll 128 is arranged in the neighborhood of the brush roll 122. The recovery roll 128 is rotatable while in contact with the soft filaments 126 of the brush roll 122. The recovery roll 128 is formed of a metallic material, such as an aluminum alloy. Under the recovery roll 128, a feeding screw 130 is rotatably arranged such that it is located close to the inner wall of the housing 118. In cooperation with the inner wall of the housing 118, the feeding screw 130 constitutes a conveyor.

The brush roll 126 is electrically connected to a d.c. bias source 132, by which the soft filaments 126 are applied with a predetermined bias voltage E1 (e.g., −150 V). The polarity of the bias voltage E1 is opposite to that of the charged toner particles attracted on the photosensitive surface 12 of the photosensitive drum 10. Like the brush roll 126, the recovery roll 128 is electrically connected to a d.c. bias source 134. This d.c. bias source 134 applies a predetermined voltage E2 (e.g., −300 V) to the recovery roll 128. Bias voltage E2 has the same polarity as bias voltage E1, but its absolute value is larger than that of bias voltage E1 ($|E2|>|E1|$).

A blade 136 is fixed to the inner wall of the housing 118 such that it is in contact with the circumference of the recovery roll 128.

A cleaning charger 138 is arranged just under the housing 118, as viewed in FIG. 8. The cleaning charger 138 is located close to the photosensitive surface 12 of the photosensitive drum 10, and has a similar structure to that of the charger 66 mentioned above.

The cleaning charger 138 charges the fluidizer particles into the same polarity as that of the toner particles attracted on the photosensitive surface 12 of the photosensitive drum 10, i.e., into the polarity opposite to that in which the fluidizer particles are charged by friction.

The brush roll 122 and the recovery roll 128 are rotated by a driving device (not shown) in the directions indicated by arrows in FIG. 8. As indicated in FIG. 8, the rotating directions of the brush roll 122 and recovery roll 128 are the same as that of the photosensitive drum 10. When the brush roll 122 and the recovery roll 128 are rotated, they are kept applied with bias voltages E1 and E2, respectively.

A toner image formed on the photosensitive surface 12 of the photosensitive drum 10 is transferred onto the continuous recording sheet S by the transfer device 20. After this toner image transfer, that portion of the photosensitive surface 12 from which the toner image is transferred approaches the cleaning device 116. If the developer, namely particles of toner and fluidizer, is left on the photosensitive surface 12 after passing by the transfer device 20, the particles of the fluidizer are charged by the cleaning charger 138 into the same polarity as that of the toner particles.

Thereafter, when the developer left on the photosensitive surface 12 reaches the location of the brush roll 122, it is electrostatically attracted by the soft filaments 126 of the brush roll 122. In this manner, the residual developer, namely residual toner particles and fluidizer particles, is removed from the photosensitive surface 12.

The residual developer attracted by the soft filaments 126 of the brush roll 122 is electrically attracted on the circumference of the recovery roll 128, due to the difference between bias voltages E1 and E2. The developer, thus attracted on the recovery roll 128, is scraped off the recovery roll 128 by the blade 136, and is fed to a recovery container (not shown) by the feeding screw 130.

The developer used in the present invention contains toner particles and fluidizer particles, and the fluidizer particles are frictionally-charged into the opposite polarity to that of the toner particles. As mentioned above, however, the cleaning device 116 of the embodiment comprises the above-mentioned cleaning charger 138, and this cleaning charger 138 charges the fluidizer particles remaining on the photosensitive surface 12 into the same polarity as the toner particles before the residual toner reaches the location of the brush roll 122. Therefore, both the toner particles and the fluidizer particles are electrostatically attracted by the soft filaments 126 of the brush roll 122 at the same time, so that the cleaning effect of the cleaning device 116 is improved. Since the photosensitive surface 12 can be reliably cleaned, it is possible to improve the quality of the image transferred onto the continuous recording sheet S.

It should be noted that the residual developer is removed from the photosensitive surface 12 by means of the soft filaments 126 of the brush roll 122. Therefore, the photosensitive surface 12 of the photosensitive body 10 is prevented from being scratched or damaged.

Referring back to FIG. 1, a de-electrifying lamp 139 is located in the vicinity of the photosensitive surface 12 of the photosensitive drum 10. This de-electrifying lamp removes the electric charge from the photosensitive surface 12 after the surface 12 is cleaned by the cleaning device 116.

As is shown in FIG. 1, a photographic fixing device 140 is arranged on the downstream side of the feeding device 22 with respect to the feeding direction of the continuous recording sheet S. The photographic fixing device 140 fixes a toner image to the continuous recording sheet S while the sheet S is passing therethrough.

Figure 9:
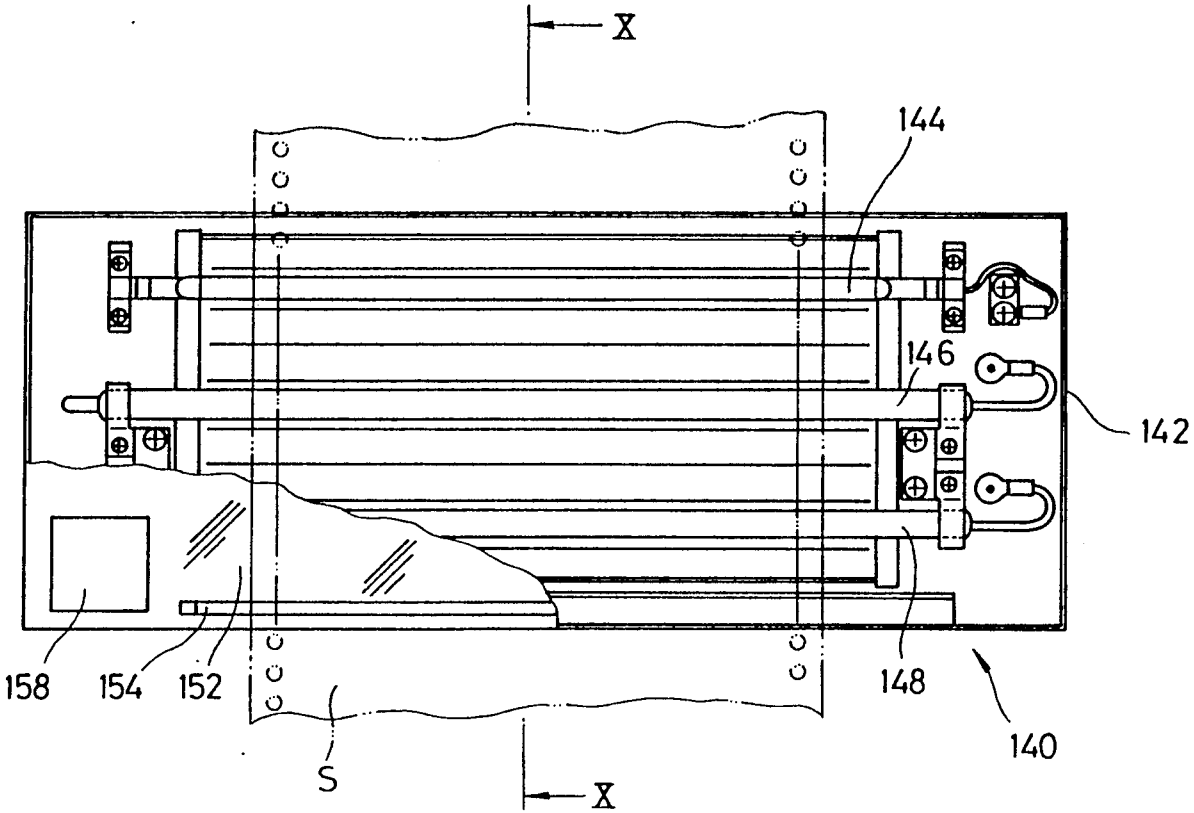
FIG. 9 is a partially-cutaway bottom view of a photographic fixing device incorporated in the printer shown in FIG. 1.
Figure 10:
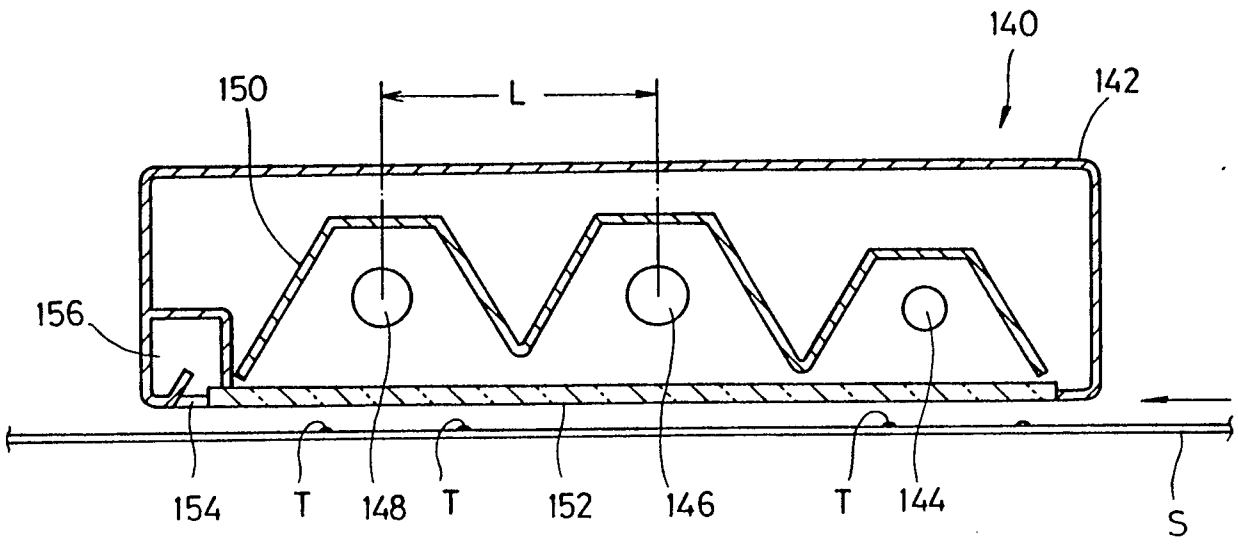
FIG. 10 is a sectional view taken along line X—X in FIG. 9.

The structure of the photographic fixing device 140 will now be described in detail, with reference to FIGS. 9 and 10.

The photographic fixing device 140 comprises a lamp case 142 which is open in the lower region thereof. A halogen lamp 144, a first xenon flash lamp 146, and a second xenon flash lamp 148 are arranged in the feeding direction of the continuous recording sheet S in the order mentioned. As is apparent from FIG. 9, the lamps 144, 146 and 148 extend across the continuous recording sheet S in parallel to one another and are electrically connected to their respective power sources.

Inside the lamp case 142, a reflector 150 is arranged between the lamps 144, 146 and 148 and the upper wall of the lamp case 142. The reflector 150 has a corrugated shape, if viewed in the feeding direction of the sheet S. With this shape of the reflector 150, the radiation heat energy and optical energy emitted from each of the lamps 144, 146 and 148 can be effectively transmitted to the continuous recording sheet S.

To protect the lamps, the open lower region of the lamp case 142 is covered with a glass plate 152. The glass plate 152 serves to prevent toner, dust, or the like from attaching to the lamps 144, 146 and 148. A gas discharge hole 154 is formed in the lower wall of that end of the lamp case 142 which is downsteam with reference to the feeding direction of the continuous recording sheet S. The gas discharge hole 154 extends in the widthwise direction of the continuous recording sheet S, and is open to the continuous recording sheet S. The gas discharge hole 154 is connected to an internal conduit 156 formed in the lamp case 142, and thus communicates with a connection hole 158 (FIG. 9) which is open in the outer wall of the lamp case 142. This connection hole 158 is connected to a negative-pressure source (not shown). Therefore, the gas which is generated at the time of fixing a toner image is sucked from the gas discharge hole 154, and the sucked gas is collected through the internal conduit 156 and the connection hole 158, without being discharged into the atmosphere.

When a continuous recording sheet S enters the above-mentioned fixing device, the halogen lamp 144 generates radiation heat energy of 300 W or so. With this energy, the continuous recording sheet S is preheated to a predetermined temperature, together with the toner image T transferred thereon. Then, when the continuous recording sheet S passes through the first and second xenon flash lamps 146 and 148, each xenon flash lamp provides the continuous recording sheet S and the toner image T with optical energy of flashlight within the range of 2.1 J/cm$^2$ to 2.3 J/cm$^2$. The interval f at which the first and second xenon flash lamps 146 and 148 flash is determined by the following formula:

$$f = V/L \text{ (Hz)}$$

where V is the speed at which the continuous recording sheet S is fed, and L is the distance between the first and second xenon flash lamps 146 and 148.

Since the first and second xenon flash lamps 146 and 148 flash at the interval determined as above, the continuous recording sheet S and the toner image T thereon are exposed first to the flashlight produced by the first xenon flash lamp 146. The optical energy of this flashlight mainly serves to deprive the continuous recording sheet S of moisture. Then, the continuous recording sheet S and the toner image T are exposed to the flashlight produced by the second xenon flash lamp 148. The optical energy of this flashlight mainly serves to fix the toner image T to the sheet S.

In this manner, the continuous recording sheet S and the toner image T are exposed to flashlight twice by the photographic fixing device 142 of the embodiment. Before the exposure to the flashlight, the continuous recording sheet S and the toner image T are preheated by the radiation heat energy generated by the halogen lamp 144. Therefore, the density of the optical energy of the flashlight irradiated at one time can be reduced to the range of 2.1 J/cm$^2$ to 2.3 J/cm$^2$, as mentioned above. Since, therefore, the toner is not overheated, it is prevented from decomposing. Thus, the toner does not bubble, nor does it scatter over the sheet S. Accordingly, the toner image T can be fixed onto the sheet S in a stable manner and at high speed. In addition, since the amount of gas which may be generated by the decomposition of the toner is suppressed, no bad-smelling gas is generated.

Let it be assumed that, after a continuous recording sheet S and a toner image T are preheated, the removal of moisture and the fixing of the toner image are simultaneously performed by irradiating flashlight once onto the sheet S and the toner image T. In this case, the density of optical energy required should be higher than 3.0 J/cm$^2$, according to experiments conducted by the inventors. However, if optical energy having such a high density is used, it is likely that the toner will markedly bubble or scatter over the sheet S, increasing the amount of gas generated by the decomposition of toner.

The fixing device 142 of the above embodiment preheats the continuous recording sheet S and the toner image T. Since the purpose of this preheating operation is to enable easy execution of the subsequent moisture removal and image fixing, the amount of energy required for the preheating operation can be small. Thus, the performance of the preheating operation does not lengthen the actuation time of the photographic fixing device 114.

The present invention is not limited to the embodiment mentioned above, and may be modified in various manners. In the above embodiment, the photosensitive medium is constituted by a photosensitive drum 10, but may be constituted by a photosensitive belt.

The continuous recording sheet which can be used in the printer of the present invention is not limited to a foldable type, such as a fanfold sheet. Needless to say, another type of continuous recording sheet, such as a rolled sheet, can be used.

With respect to the halogen lamp 144, the photographic fixing device 140 may be replaced with another type of radiation heat energy-generating means, such as an infrared ray lamp or an electric heater. In addition, each of the xenon flash lamps 146 and 148 may be replaced with another type of optical energy-generating means, such as a neon flash lamp, an argon flash lamp, or a krypton flash lamp. Moreover, the number of times at which irradiation of flashlight is performed need not be two, as in the above embodiment, but may be three or more. Further, only one lamp may be used and flashed at least twice, thereby producing the same effects as attained by using at least two lamps.

The above embodiment was described, referring to an electrophotographic printer which effects monochromatic printing onto a continuous recording sheet S. However, the continuous recording sheet-feeding device, the cleaning device and the photographic fixing device, which are incorporated in the electrophotographic printer, are also applicable to which effects dichromatic photographic printing onto a continuous recording sheet. A printer of such type is disclosed, for example, in the following publications: Japanese Patent Disclosures No. 58-46360, No. 58-108551 and No. 60-249168, and Japanese Patent Publication No. 62-52297.

Finally, the continuous recording sheet-feeding device of the above embodiment is applicable not only to an electrophotographic printer but also to an ordinary type of printing machine which uses ink.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic printer comprising:

a photosensitive medium having a movable photosensitive surface;

means for uniformly charging the photosensitive surface of the photosensitive medium;

means for forming an electrostatic latent image on the charged photosensitive surface;

developing means for affixing toner to the electrostatic latent image on the photosensitive surface by use of a developer, so as to obtain a toner image;

a feeding device for feeding a continuous recording sheet to the photosensitive medium, tractor means, located on an upstream side of the photosensitive medium with reference to a feeding direction of the continuous recording sheet, for feeding the continuous recording sheet to the photosensitive medium; and pull means, located on a downstream side of the photosensitive medium with reference to the feeding direction of the continuous recording sheet, for pulling the continuous recording sheet from the photosensitive medium, said pull means having: (a) a pair of rolls isolated from each other in the feeding direction; (b) an endless belt which is extended between the rolls and which can be electrically charged; (c) driving means for rotating one of the rolls, to thereby cause the endless belt to travel in one direction; (d) charging means, arranged in the neighborhood of the endless belt, for electrically charging the endless belt; and (e) means located in the neighborhood of the endless belt for preventing the endless belt from being electrically overcharged;

means for transferring the toner image from the photosensitive medium onto the continuous recording sheet;

a cleaning device for clearing the photosensitive surface of the photosensitive medium, so as to remove the developer which remains on the photosensitive surface after the toner image is transferred onto the continuous recording sheet;

a photographic fixing device for fixing the toner image transferred onto the continuous recording sheet; and means for removing electric charges from the photosensitive surface of the photosensitive medium after the photosensitive surface is cleaned by the cleaning device.

2. The printer according to claim 1, wherein said pull means further includes means for supporting the endless belt such that the endless belt is brought into contact with or moved away from the photosensitive medium.

3. The printer according to claim 1, wherein developing means contains a developer made up of toner particles and fluidizer for fluidizing the toner particles, said fluidizer being made of a material which is frictionally charged into an opposite polarity to that of the toner particles.

4. The printer according to claim 3, wherein said cleaning device includes:

charging means for charging residual fluidizer, which remains on the photosensitive surface after the toner image is transferred onto the continuous recording sheet, into the same polarity as residual toner, which also remains on the photosensitive surface; and a brush roll, rotatably arranged in contact with the photosensitive surface of the photosensitive medium, for electrostatically attracting the residual toner and the residual fluidizer, which are of the same polarity, so as to remove the residual toner and the residual fluidizer from the photosensitive surface.

5. The printer according to claim 4, wherein said cleaning device further includes:

a recovery roll, rotatably arranged in contact with the brush roll, for attracting the developer electrostatically on the brush roll by utilization of electrostatic attraction larger than that of the brush roll; and separating means for scraping the developer from the recovery roll.

6. The printer according to claim 1, wherein said photographic fixing means includes:

preheating means for preheating the continuous recording sheet and the toner image thereon by providing radiation heat energy for the continuous recording sheet and the toner image;

optical energy-providing means for providing optical energy for the preheated continuous recording sheet at least twice, to thereby remove moisture from the continuous recording sheet, and fix the toner image to the continuous recording sheet.

7. The printer according to claim 6, wherein said optical energy-providing means includes a lamp which produces a flash of light.

8. The printer according to claim 6, wherein said optical energy-providing means includes:

first optical energy-providing means for removing moisture from the continuous recording sheet; and second optical energy-providing means for fixing the toner image to the continuous recording sheet of which moisture has been removed.

9. The printer according to claim 8, wherein said preheating means includes a lamp which generates radiation heat energy, and each of said first and second optical energy-providing means includes a lamp which produces a flash of light.

* * * * *